US012535264B2

(12) United States Patent
Tae

(10) Patent No.: US 12,535,264 B2
(45) Date of Patent: Jan. 27, 2026

(54) REFRIGERATOR

(71) Applicant: LG Electronics Inc., Seoul (KR)

(72) Inventor: Dongbeen Tae, Seoul (KR)

(73) Assignee: LG Electronics Inc., Seoul (KR)

( * ) Notice: Subject to any disclaimer, the term of this patent is extended or adjusted under 35 U.S.C. 154(b) by 552 days.

(21) Appl. No.: 17/825,190

(22) Filed: May 26, 2022

(65) Prior Publication Data

US 2022/0381507 A1 Dec. 1, 2022

(30) Foreign Application Priority Data

May 26, 2021 (KR) ..... 10-2021-0067670

(51) Int. Cl.
*F25D 23/12* (2006.01)
*F25D 23/02* (2006.01)

(52) U.S. Cl.
CPC ..... *F25D 23/126* (2013.01); *F25D 23/028* (2013.01)

(58) Field of Classification Search
CPC ..... F25D 2323/122; F25D 23/126; F25D 23/028; F25D 23/00; F25D 2323/121; F25D 2331/806; F25D 23/061; B67D 2210/00036; F25C 2400/14; F16L 25/14
See application file for complete search history.

(56) References Cited

U.S. PATENT DOCUMENTS 4,036,620 A 7/1977 Benasutti et al.
2005/0039482 A1 2/2005 Kim et al.
2007/0175919 A1* 8/2007 Hortin ..... B67D 1/0009 222/64
2008/0142431 A1 6/2008 Lim et al.
2012/0111048 A1* 5/2012 Kim ..... F25C 1/10 62/340
2014/0165602 A1* 6/2014 Boarman ..... F25C 1/20 62/157
2014/0230481 A1* 8/2014 Yun ..... B67D 1/0014 62/340

(Continued)

FOREIGN PATENT DOCUMENTS

CN 1599856 A 3/2005
DE 102006002445 A 7/2007

(Continued)

OTHER PUBLICATIONS

Extended Search Report in European Appln. No. 22175385.8, dated Sep. 29, 2022, 7 pages.

*Primary Examiner* — Tavia Sullens
(74) *Attorney, Agent, or Firm* — Fish & Richardson P.C.

(57) ABSTRACT

A refrigerator includes a cabinet defining a storage space, a water tank provided inside the storage space, a door rotatably connected to the cabinet by a hinge and configured to open and close the storage space, a dispenser provided in the door, and a water supply path connecting the water tank and the dispenser through the hinge and supplying water from the water tank to the dispenser. The water supply path includes a first pipe communicating with an output side of the water tank, a second pipe extending toward the dispenser and at least partially exposed through a rear surface of the cabinet, and a connector connecting an end part of the first pipe and an end part of the second pipe. An inner diameter of the second pipe is smaller than an inner diameter of the first pipe.

16 Claims, 8 Drawing Sheets

(56) References Cited

U.S. PATENT DOCUMENTS

| | | | | |
|---|---|---|---|---|
| 2016/0341462 | A1* | 11/2016 | Kim | F25D 23/068 |
| 2020/0124333 | A1 | 4/2020 | Aranda et al. | |
| 2022/0275988 | A1* | 9/2022 | Park | F25D 11/02 |

FOREIGN PATENT DOCUMENTS

| | | | | |
|---|---|---|---|---|
| KR | 20160055741 | A1 | 5/2016 | |
| KR | 20170067705 | A * | 6/2017 | F25D 23/00 |
| WO | WO-2011007903 | A1 * | 1/2011 | F25C 1/24 |

* cited by examiner

REFRIGERATOR

CROSS-REFERENCE TO RELATED APPLICATIONS

The present application claims priority under 35 U.S.C. 119 and 35 U.S.C. 365 to Korean Patent Application No. 10-2021-0067670, filed on May 26, 2021, the disclosure of which is hereby incorporated by reference in its entirety.

TECHNICAL FIELD

The present disclosure relates to a refrigerator.

BACKGROUND

In general, a refrigerator is a home appliance that can store food at a low temperature in an internal storage space that is shielded by a door. To this end, the refrigerator is configured to store the stored food in an optimal state by cooling the inside of the storage space using cold air generated through heat exchange with the refrigerant circulating in the refrigeration cycle.

Recently, refrigerators are gradually becoming larger and multifunctional in accordance with changes in dietary habits and the trend of luxury products, and refrigerators equipped with various structures and convenient devices for user convenience and efficient use of internal space have been released.

In particular, in recent years, a refrigerator equipped with a dispenser capable of discharging purified water and ice at the outside has been used. In addition, a refrigerator that is provided with a plurality of ice makers to discharge ice from the outside and opens a door to take out the ice is being used.

Meanwhile, in the case of a refrigerator having a water tank in the refrigerating chamber, since water supplied to the dispenser is cooled and stored before being supplied, cold water can always be supplied to a user who discharges water using the dispenser.

However, a pipe is arranged to connect a space between the water tank inside the refrigerating chamber and the dispenser provided on the door, and the pipe is at least partially exposed to the outside of the refrigerator in order to reduce installation convenience and manufacturing cost.

In addition, when the temperature outside the refrigerator is high, the temperature of the water supplied along the pipe is changed due to the pipe passing through the outside of the refrigerator, when the user discharges water after not using the dispenser for a long time, the temperature of the first water discharged is higher than the set temperature which may cause user dissatisfaction.

Of course, the entire pipe may be disposed without being exposed to the outside and buried in an adiabatic material, but, in this case, the assembly operation of the refrigerator is complicated and manufacturing cost is increased, and when the pipe has to be separated for replacement or repair of the pipe, there is a problem in that the pipe work is very difficult or impossible.

SUMMARY

This Summary is provided to introduce a selection of concepts in a simplified form that are further described below in the Detailed Description. This Summary is not intended to identify all key features or essential features of the claimed subject matter, nor is it intended to be used alone as an aid in determining the scope of the claimed subject matter.

An object of an embodiment of the present disclosure is to provide a refrigerator in which water of a set temperature can always be discharged when water is discharged from a dispenser.

An object of an embodiment of the present disclosure is to provide a refrigerator capable of minimizing a rise in the temperature of water discharged through the dispenser even when a water pipe supplied to the dispenser is exposed to the outside of the refrigerator.

An object of an embodiment of the present disclosure is to provide a refrigerator capable of providing an efficient pipe structure capable of connecting between a water tank, a plurality of ice makers, and dispensers in a double-door refrigerator.

An object of an embodiment of the present disclosure is to provide a refrigerator with improved serviceability and assembly.

A refrigerator according to an embodiment of the present disclosure may include: a cabinet forming a storage space; a water tank provided inside the storage space and storing water; a door that is rotatably mounted to the cabinet by a hinge device and opens and closes the storage space by rotation; a dispenser provided in the door and from which water is discharged; and a water supply path connecting the water tank and the dispenser through the hinge device and supplying water from the water tank to the dispenser, in which the water supply path may include a first pipe communicating with an output side of the water tank; a second pipe extending toward the dispenser and at least partially exposed through a rear surface of the cabinet; and a connector connecting an end part of the first pipe and an end part of the second pipe, and an inner diameter of the second pipe may be smaller than an inner diameter of the first pipe.

The storage space of the cabinet may be divided into a refrigerating chamber and a freezing chamber, and the water tank and the first pipe may be provided in the refrigerating chamber.

A filter for purifying water supplied to the water tank may be provided inside the refrigerating chamber.

The refrigerating chamber and the freezing chamber may be arranged side by side on both left and right sides, and the dispenser may be provided in a freezing chamber door that shields the freezing chamber.

The connector may be provided inside the refrigerating chamber, and the connector may include a first connection part into which an end part of the first pipe is inserted, and a second connection part into which an end part of the second pipe is inserted, and the inner diameter of the first connection part may be formed larger than the inner diameter of the second connection part.

An opening through which the second pipe may pass through a rear surface of the cabinet may be formed on a rear wall surface of the refrigerating chamber, and a cover for shielding the opening and the water tank may be provided in the refrigerating chamber.

The water tank may be formed in a shape in which a tube is continuously wound, and may be fixedly mounted on the cover.

A part of the first pipe, the connector, and the second pipe may be shielded by the cover.

A valve connecting the output side of the water tank and the first pipe may be provided, and the valve may be shielded by the cover.

A pipe support part for supporting so that pipes constituting the water supply path including the input side of the water tank and the second pipe face the opening may be formed to protrude from the rear surface of the cover.

The refrigerator may further include a sealing member formed of an adiabatic material and filling the opening, in which the sealing member may pass through the pipes and may be shielded by the cover.

A cover fixing part extending rearward and fixedly mounted on the rear wall surface of the refrigerating chamber may be provided on one side end of the cover and the cover may maintain a predetermined distance from the rear wall surface of the refrigerating chamber by the cover fixing part.

A pull-out drawer may be disposed in front of the cover, and the cover may be shielded by the drawer.

A cold air hole through which cold air is introduced for cooling the water tank may be formed on one side of a front surface of the cover corresponding to the position of the water tank.

The first pipe and the connector may be provided inside the storage space, and the second pipe may extend from the outside of the cabinet toward the top of the cabinet after passing through the rear wall surface of the cabinet.

A cabinet connecter which connects the second pipe and a third pipe extending to the inner part of the door by passing through the rear and upper surfaces of the cabinet and the hinge device in turn may be provided on the rear surface of the cabinet, and an inner diameter of the third pipe may be smaller than an inner diameter of the second pipe.

A dispenser connector connecting a third pipe and a fourth pipe connected to the dispenser may be provided inside the door, and an inner diameter of the fourth pipe may be the same as that of the second pipe.

In another aspect, a refrigerator according to an embodiment of the present disclosure may include: a cabinet in which a refrigerating chamber and a freezing chamber are formed on both left and right sides, and in which a machine room is formed at a lower end; a refrigerating chamber door for opening and closing the refrigerating chamber; a freezing chamber door for opening and closing the freezing chamber; a first ice maker provided in the freezing chamber door; a second ice maker provided in the freezing chamber; a water supply valve provided in the machine room and configured to adjust the flow of water supplied from a water supply source at the outside of the refrigerator; a filter provided in the refrigerating chamber to purify supplied water; a water tank provided in the refrigerating chamber and storing water purified by the filter; a dispenser provided in the freezing chamber door and discharging the ice made by the first ice maker and the water stored in the water tank to the outside; and a water supply path connecting the water supply source, a water supply valve, a filter, a water tank, a first ice maker, a second ice maker and a dispenser, in which the water supply path may include: a first pipe communicating with an output side of the water tank; a second pipe at least partially exposed through a rear surface of the cabinet and extending to a side of the dispenser; and a connector connecting an end part of the first pipe and an end part of the second pipe, and an inner diameter of the second pipe may be smaller than an inner diameter of the first pipe.

The water supply path may further include: a water supply pipe connecting the water supply source and the water supply valve; a filter input pipe connecting the water supply valve and the filter; a filter output pipe connecting the filter and the water tank; a first ice maker pipe connecting the water tank and the first ice maker; and a second ice maker pipe connecting the water tank and the second ice maker.

An opening through which the filter output pipe, a first ice maker pipe, the second ice maker pipe, and the second pipe pass may be formed at the rear wall surface of the refrigerating chamber. The refrigerating chamber may further include a cover on which the water tank is mounted, and the cover may shield the water tank and the opening.

DETAILED DESCRIPTIONS

Hereinafter, specific embodiments of the present disclosure will be described in detail with drawings. However, the present disclosure cannot be said to be limited to the embodiments in which the spirit of the present disclosure is presented, and other disclosures that are degenerate by addition, changes, deletions, or the like of other elements or other embodiments included within the scope of the present disclosure can be easily suggested.

In addition, the embodiment of the present disclosure will be described as an example of a side-by-side type or double-door type refrigerator in which a pair of doors are disposed on left and right sides for convenience of explanation and understanding, and it should be noted in advance that the present disclosure is applicable to all refrigerators provided with a dispenser.

Figure 1:
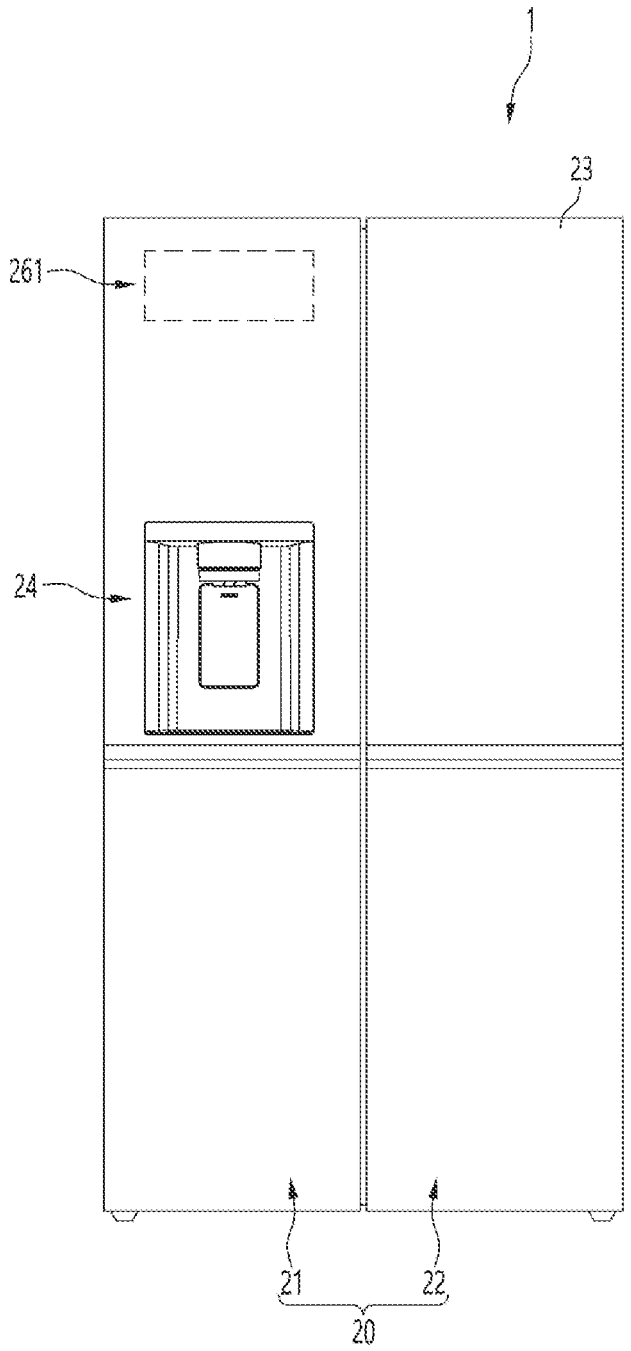
FIG. 1 is a front view illustrating a refrigerator according to an embodiment of the present disclosure.
Figure 2:
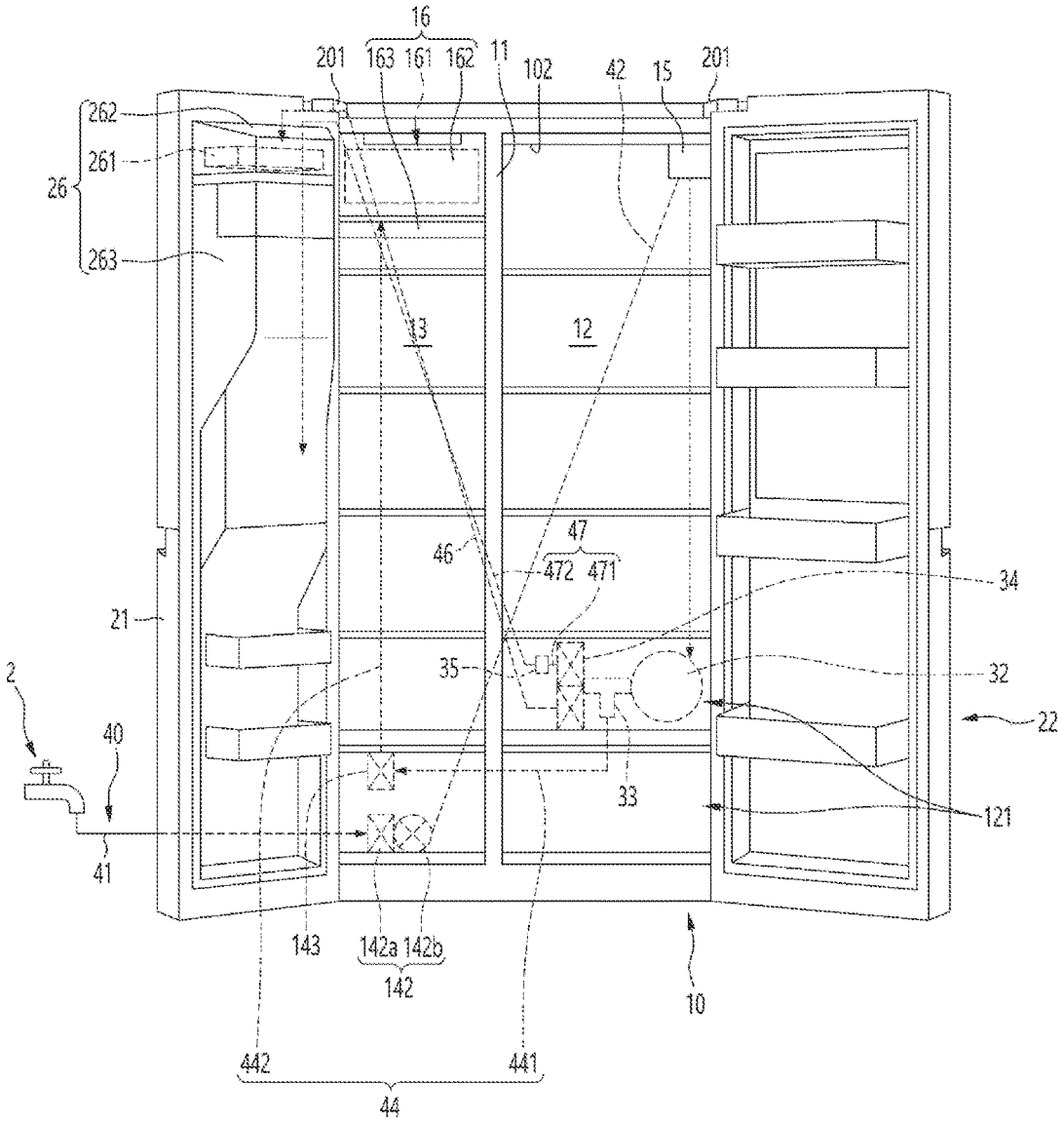
FIG. 2 is a view illustrating a water flow path a state where the refrigerator door is opened.

Before the description, the direction is defined. in FIGS. 1 and 2, the direction toward the door with respect to the cabinet may be referred to as a front direction, the direction toward the cabinet with respect to the door may be referred to as a rear direction, the direction toward the floor on which the refrigerator is installed may be referred to as a downward direction, and the direction away from the floor on which the refrigerator is installed may be referred to as an upward direction.

Figure 3:
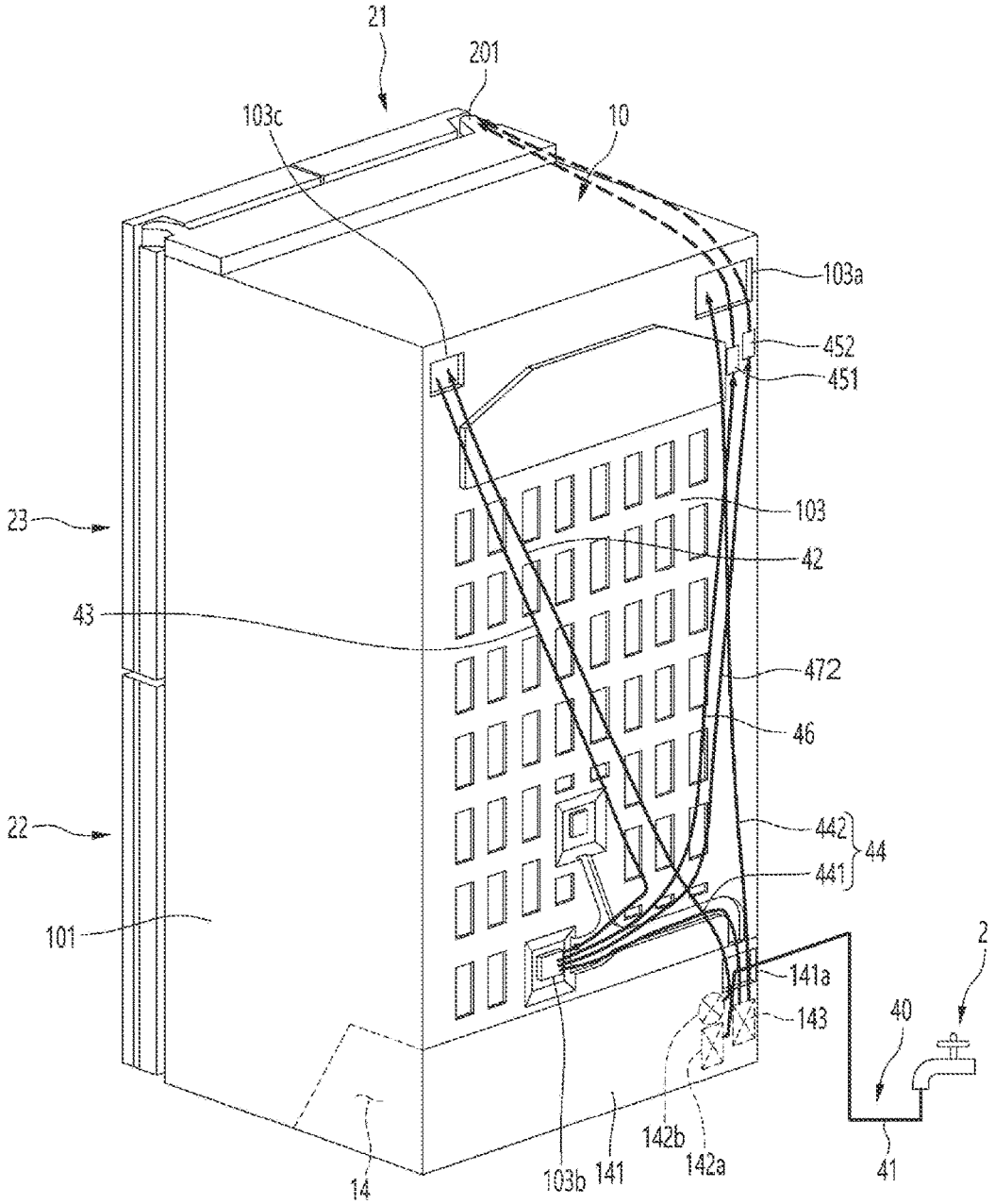
FIG. 3 is a view illustrating a water flow path when the refrigerator is viewed from the rear.

FIG. 1 is a front view illustrating a refrigerator according to an embodiment of the present disclosure, FIG. 2 is a view illustrating a water flow path a state where the refrigerator door is opened, and FIG. 3 is a view illustrating a water flow path when the refrigerator is viewed from the rear.

As illustrated in the drawing, the outer appearance of the refrigerator 1 according to an embodiment of the present disclosure may be formed by a cabinet 10 forming a storage space, and a door 20 coupled to the cabinet 10 to open and close the storage space.

The cabinet 10 may include an outer case 101 forming an outer appearance and an inner case 102 provided inside the outer case 101 to form a storage space. In addition, an adiabatic material may be filled between the outer case 101 and the inner case 102. In addition, the rear surface of the cabinet may be formed by the back plate.

A barrier 11 may be formed on the inner case 102. The barrier 11 may partition the storage space inside the cabinet 10 in the left and right direction so that the refrigerating chamber 12 and the freezing chamber 13 are formed side by side. The inner case 102 may form inner surfaces of the refrigerating chamber 12 and the freezing chamber 13.

A machine room 14 may be formed at a lower rear end of the cabinet 10. The machine room 14 may form a space in which a plurality of components including a compressor and a condenser constituting a refrigeration cycle are disposed. In addition, the rear surface of the machine room 14 may be opened, and the opened rear surface of the machine room 14 may be shielded by the machine room cover 141.

A water supply valve 142*a* connected to an external water supply source 2 may be provided inside the machine room 14. The water supply valve 142*a* controls the flow of water flowing in from the water supply source 2 and may be connected to a water supply pipe 41 extending from the water supply source 2.

In this case, the water supply source 2 may be an external facility of the refrigerator 1 such as a water supply and may be connected to the water supply valve 142*a* inside the machine room 14 by the water supply pipe 41. Since the water supply valve 142*a* is disposed inside the machine room 14 instead of the inside of the refrigerator, it is possible to secure an interior space of the refrigerator and prevent safety problems.

In addition, a flow sensor 142*b* may be provided at one side of the water supply valve 142*a*. The flow rate of the water supplied to the inside of the refrigerator 1 may be detected by the flow sensor 142*b*, and the flow rate for controlling the operation of the water supply valve 142*a* may be detected. The water supply valve 142*a* and the flow rate sensor 142*b* may be integrally configured and may be referred to as a water supply valve assembly 142.

Meanwhile, an ice maker valve 143 may be provided inside the machine room 14. The ice maker valve 143 may be disposed on a second ice maker pipe 44 extending from the water tank 32 and the second ice maker 161 to be described below.

In detail, the second ice maker pipe 44 may include an ice maker input pipe 441 extending from the water tank 32 and an ice maker output pipe 442 extending from the second ice maker 161. The ice maker valve 143 may connect the ice maker input pipe 441 and the ice maker output pipe 442.

Accordingly, the ice maker valve 143 may adjust the flow of water supplied from the water tank 32 to the second ice maker 161. Since the ice maker valve 143 is also arranged inside the machine room 14, it is possible to secure a space in the refrigerator and prevent safety problems.

In addition, the water supply pipe 41 toward the water supply valve 142*a*, the filter input pipe 42 from the water supply valve 142*a* to the filter 15, and the ice maker input pipe 441 toward the ice maker valve 143, and the ice maker output pipe 442 toward the second ice maker 161 may be exposed to and disposed on the rear of the cabinet 10 through the machine room cover pipe inlet 141*a*.

A filter 15 for purifying water flowing through the water supply valve 142*a* may be provided in the refrigerating chamber 12. The filter 15 is for purifying the water supplied to the water tank 32 and may be detachably disposed inside the refrigerating chamber 12. For example, the filter 15 may be disposed at an upper corner of the refrigerating chamber 12. Accordingly, due to the arrangement of the filter 15, the user can easily replace the filter 15 while minimizing interference with the food stored in the refrigerating chamber 12.

The filter 15 may extend in the front and rear direction and may be accommodated in a separate case. In addition, the rear end of the filter 15 or a part of a pipe connected to the rear end of the filter 15 may be exposed to the rear surface of the cabinet 10. The filter input pipe 42 and the filter output pipe 43 connected to the filter 15 may be connected to the filter 15 through the rear surface of the cabinet 10. Accordingly, the filter input pipe 42 and the filter output pipe 43 may be connected to the filter 15 through the filter side connection part 103*c* formed at the upper corner of the back plate 103.

In addition, a water tank 32 ("water storage") for storing water purified by the filter 15 may be provided inside the refrigerating chamber 12. The water tank 32 stores water supplied to the dispenser 24, the first ice maker 261, and the second ice maker 161 and may be cooled by the cold air of the refrigerating chamber 12. Accordingly, when water is discharged from the dispenser 24, the user can dispense water cooled to a set temperature.

A valve 33 for adjusting the flow of water discharged from the water tank 32 to the first ice maker 261 and the dispenser 24 may be provided inside the refrigerating chamber 12. According to the operation of the valve 33, the water in the water tank 32 may be selectively supplied to the dispenser 24 and the first ice maker 261. In this case, a dispenser pipe 47 is connected to one side of the valve 33 to supply water to the dispenser 24. The dispenser pipe 47 may include a first pipe 471 connected to the valve 33, a second pipe 472 facing the dispenser 24, and a connector 35 for connecting the first pipe 471 and the second pipe 472. The structures of the dispenser pipe 47 and the connector 35 will be described in more detail below.

In addition, the other side of the valve 33 may be connected to the first ice maker pipe 46 to supply water to the first ice maker 261.

The water discharged from the water tank 32 may be branched by the branching member 33. In addition, the branch member 33 may be connected to the second ice maker pipe 44 to supply water from the water tank 32 to the second ice maker 161. In this case, the second ice maker pipe 44 may include an ice maker input pipe 441 connected to the branch member 33 and an ice maker output pipe 442 connected to the second ice maker 161, and the ice maker input pipe 441 and the ice maker output pipe 442 may be connected by the ice maker valve 143.

A water tank 32, a valve 33, a branch member 33, and a part of the water supply path 40 provided in the refrigerating chamber 12 may be shielded by a cover 31 mounted on the refrigerating chamber 12. A state where the water tank 32, the valve 33, the branch member 33, and the water supply path 40 are mounted on the rear surface of the cover may be referred to as a cover assembly 30. The cover 31 and the cover assembly 30 will be described in more detail below.

In addition, although not illustrated, an evaporator may be provided at the rear of the freezing chamber 13, and the cold air generated by the evaporator is supplied to the refrigerating chamber 12 and the freezing chamber 13 and thus the refrigerating chamber 12 and the freezing chamber 13 can be maintained at the set temperature.

A second ice maker 161 may be provided in the freezing chamber 13. The second ice maker 161 is located at the uppermost part of the freezing chamber 13 and may be arranged side by side with the first ice maker 261 to be described below in the front and rear direction.

The second ice maker 161 is configured to make ice with water automatically supplied and to separate ice. For example, the second ice maker 161 may be configured to make spherical ice.

An ice maker cover 162 for shielding the second ice maker 161 may be provided in front of the second ice maker 161. In addition, an ice bin 163 in which the ice made in the second ice maker 161 is moved and stored may be provided below the second ice maker 161. Since the second ice maker 161 is mounted inside the freezing chamber 13, it may be referred to as an ice maker on the side of interior of the refrigerator or a cabinet ice maker. In addition, the second ice maker 161 and the ice maker cover 162 may be referred to as an ice maker assembly 16 on the side of interior of the refrigerator.

The door 20 may be disposed side by side on left and right sides, and an upper end and a lower end may be rotatably connected to the cabinet 10 by a hinge device 201 mounted on the cabinet 10. Accordingly, the door 20 may be configured to open and close the refrigerating chamber 12 and the freezing chamber 13 on the left and right sides by rotation, respectively.

In addition, the door 20 may form of the outer appearance of the front surface of the refrigerator 1 in a closed state. The door 20 may include a freezing chamber door 21 that opens and closes the freezing chamber 13, and a refrigerating chamber door 22 for opening and closing the refrigerating chamber 12.

Meanwhile, the refrigerating chamber door 22 may have an opening communicating with the accommodation space at the rear surface of the door, and a sub-door 23 for opening and closing the opening may be further formed.

A first ice maker 261 may be provided in the freezing chamber door 21. The first ice maker 261 may be provided on the upper rear surface of the freezing chamber door 21 and may be configured to make ice using automatically supplied water and separate the ice to the ice bank 263. In addition, the first ice maker 261 may be configured to make different types of ice from the second ice maker 161.

An upper cover 262 for shielding the first ice maker 261 may be provided above the first ice maker 161, and cold air may be supplied through an open side of the upper cover 262. Since the first ice maker 261 is provided in the door, the first ice maker may be referred to as a door-side ice maker. In addition, the first ice maker 261, the upper cover 262, and the ice bank 263 may be collectively referred to as a door-side ice maker assembly 26.

The first ice maker 261 may be located in front of the second ice maker 161. Accordingly, the cold air discharged from the freezing chamber 13 may be supplied to the first ice maker 261 through the second ice maker 161. Of course, if necessary, flow paths through which cold air is supplied to the first ice maker 261 and the second ice maker 161, respectively, may be provided.

A dispenser 24 may be provided on the front surface of the freezing chamber door 21. The dispenser 24 may be configured to dispense purified water or ice from the outside in a state where the freezing chamber door 21 is closed. The dispenser 24 may communicate with the ice bank 263, and thus the ice stored in the ice bank 263 may be discharged when the dispenser 24 is operated.

Hereinafter, the structure of the cover assembly 30 will be described in more detail with reference to the drawings.

Figure 4:
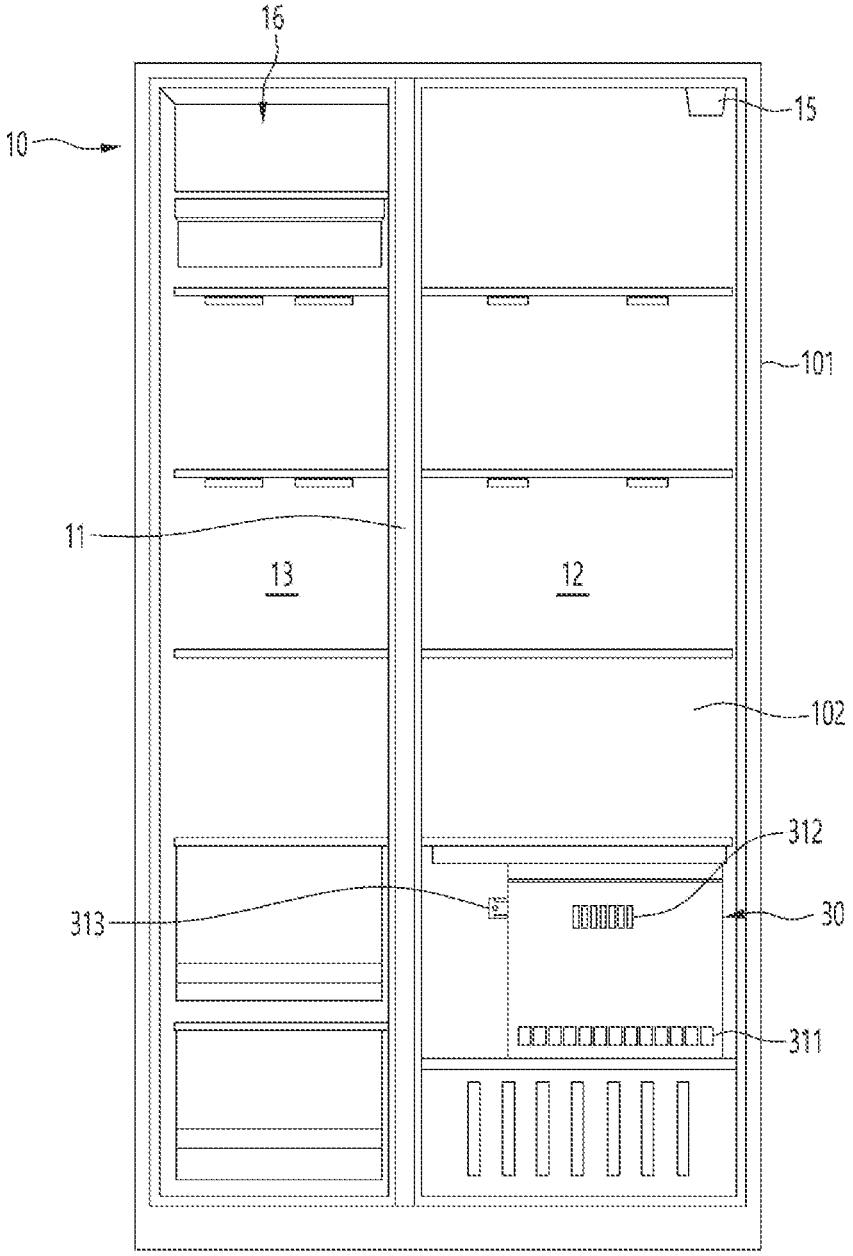
FIG. 4 is a front view illustrating a state where a tank cover is mounted according to an embodiment of the present disclosure.
Figure 5:
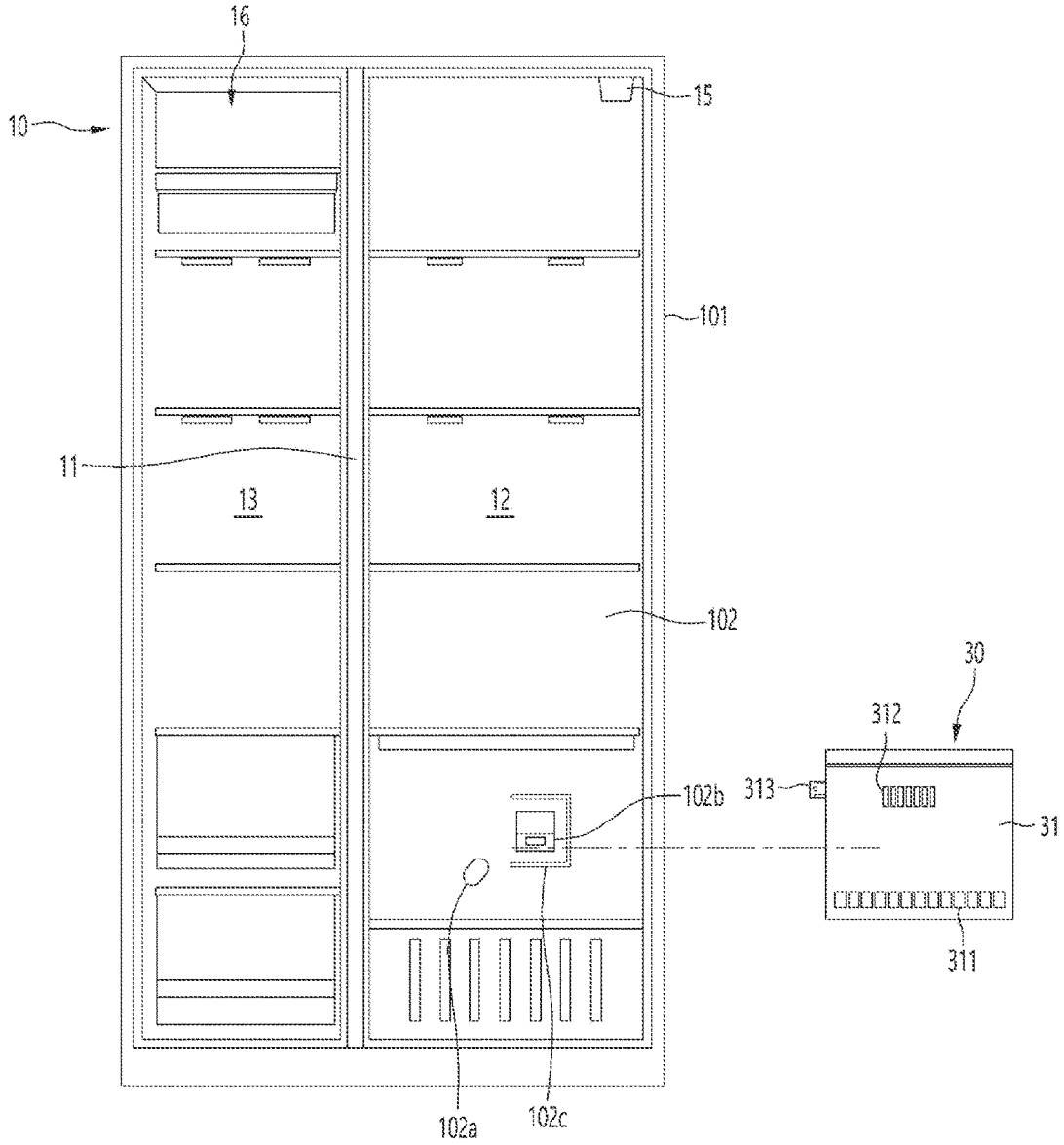
FIG. 5 is an exploded view illustrating a state where the tank cover is separated.

FIG. 4 is a front view illustrating a state where a tank cover is mounted according to an embodiment of the present disclosure, and FIG. 5 is an exploded view illustrating a state where the tank cover is separated.

As illustrated in the drawings, inner surfaces of the refrigerating chamber 12 and the freezing chamber 13 may be formed by an inner case 102. In addition, a plurality of drawers and shelves may be disposed inside the refrigerating chamber 12 and the freezing chamber 13.

The cover 31 may be provided at the rear of the drawer of the refrigerating chamber 12. In other words, as illustrated in FIG. 2, in a state where the drawer 121 is mounted on the refrigerating chamber 12, the cover 31 and the cover assembly 30 may be covered by the drawer 121.

The cover 31 may be mounted on one side of the inner case 102 forming a rear wall surface of the refrigerating chamber 12. In addition, the cover 31 may shield the opening 102*a* penetrating the rear wall surface of the refrigerating chamber 12 and the connector part 102*b* of the rear wall surface of the refrigerating chamber 12 from the front.

The opening 102*a* is opened so that the water supply flow paths 40 inside the refrigerating chamber 12 pass to the outside of the cabinet 10, and among the water supply flow paths 40, the filter input pipe 42, the first ice maker pipe 46, the second ice maker pipe 44, and the second pipe 472 may be formed to have a minimum size that can be entered and exited.

In addition, the opening 102*a* is formed to have a size corresponding to the sealing member 36 ("sealing") provided in the cover 31, and the opening 102*a* is completely shielded by the sealing member 36 to prevent leakage of cold air or the inflow of outside air. In addition, a rear opening 103*b* may be formed in the back plate 103 corresponding to the opening 102*a*. The filter output pipe 43, the first ice maker pipe 46, the second ice maker pipe 44, and the second pipe 472 may enter and exit through the rear opening 103*b*.

In addition, the connector part 102*b* is a part to which the cable connected to the valve 33 disposed behind the cover 31 and the cable connector 35 are fastened and may be electrically connected to the valve 33. A forming part 102*c* may be formed around the connector part 102*b*, and the strength of the position at which the connector part 102*b* is mounted may be reinforced by the forming part 102*c*.

When the cover 31 is mounted, the opening 102*a* and the connector part 102*b*, including the water supply path 40 disposed behind the cover 31, the water tank 32, the valve 33, and the like, may all be shielded by the cover 31.

The cover 31 may be formed of a plastic material and may be formed in a rectangular plate shape. A cold air hole 312 may be formed through one side of the cover 31. The cold air hole 312 may be formed at a position corresponding to the water tank 32, so that cold air in the refrigerating chamber 12 passes through the cold air hole 312 to be capable of cooling the water tank 32.

A circulation hole 311 may be further formed at a lower end of the cover 31. The circulation hole 311 is formed along the lower end of the cover 31, and a plurality of the circulation holes 311 may be formed to pass through the cover 31. Accordingly, the cold air introduced through the cold air hole 312 may be discharged through the circulation hole 311 after cooling the water tank 32. Accordingly, the air in the space behind the cover 31 may not be stagnant and cold air may be circulated, and effective cooling of the water tank 32 may be possible.

Meanwhile, a cover fixing part 313 ("cover fixing protrusion") may be formed on one side of the cover 31. The cover fixing part 313 may extend backward from one end of the circumference of the cover 31 and may be formed to have a predetermined length. In addition, the extended end part of the cover fixing part 313 may be fixed to the rear surface of the refrigerating chamber 12 or to one side of the inner case 102 by a screw.

A space can be secured between the wall surface of the refrigerating chamber 12 and the cover 31 by the cover fixing part 313. Accordingly, the water tank 32, the water supply path 40, the valve 33, and the like can be effectively disposed in a space between the wall surface of the refrigerating chamber 12 and the cover 31 spaced apart from each other.

Hereinafter, the structure of the cover 31 and the arrangement of components mounted on the cover 31 will be described in more detail with reference to the drawings.

Figure 6:
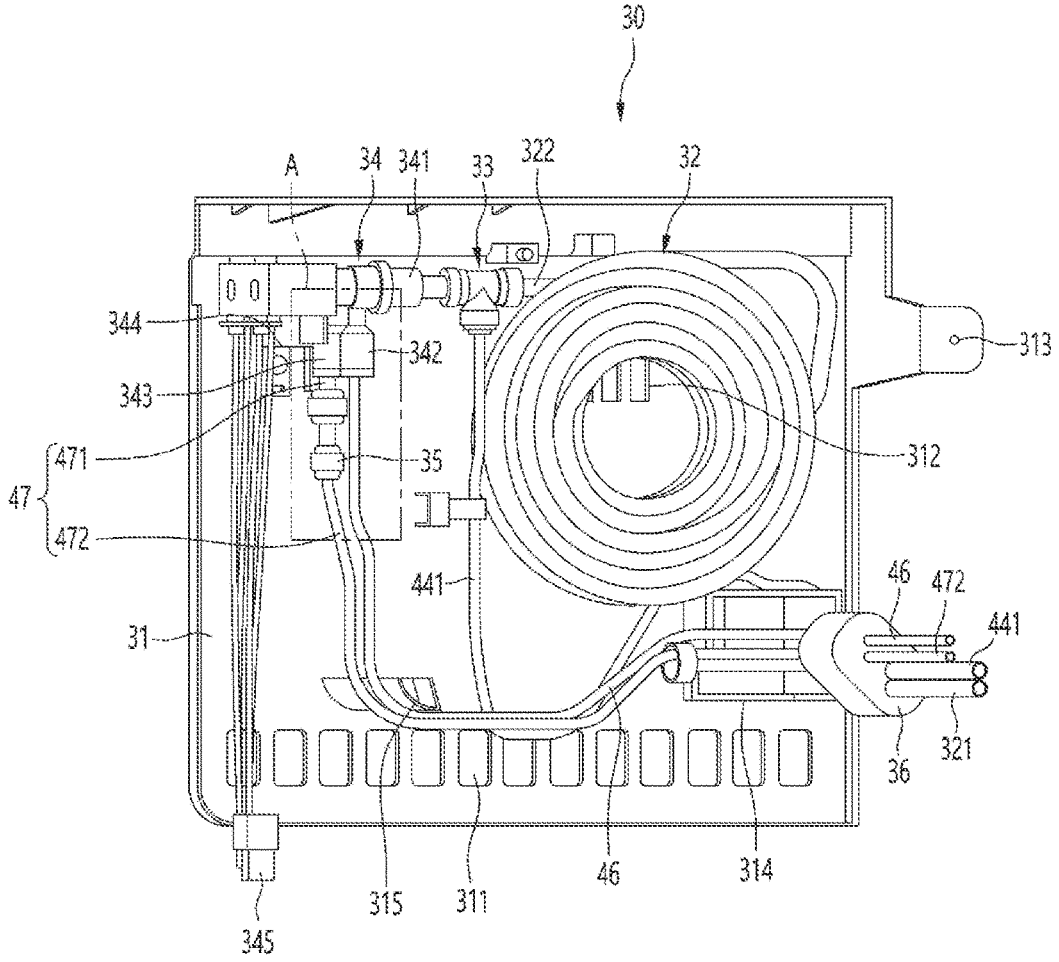
FIG. 6 is a view illustrating the arrangement of the tank cover and the components mounted on the tank cover.
Figure 7:
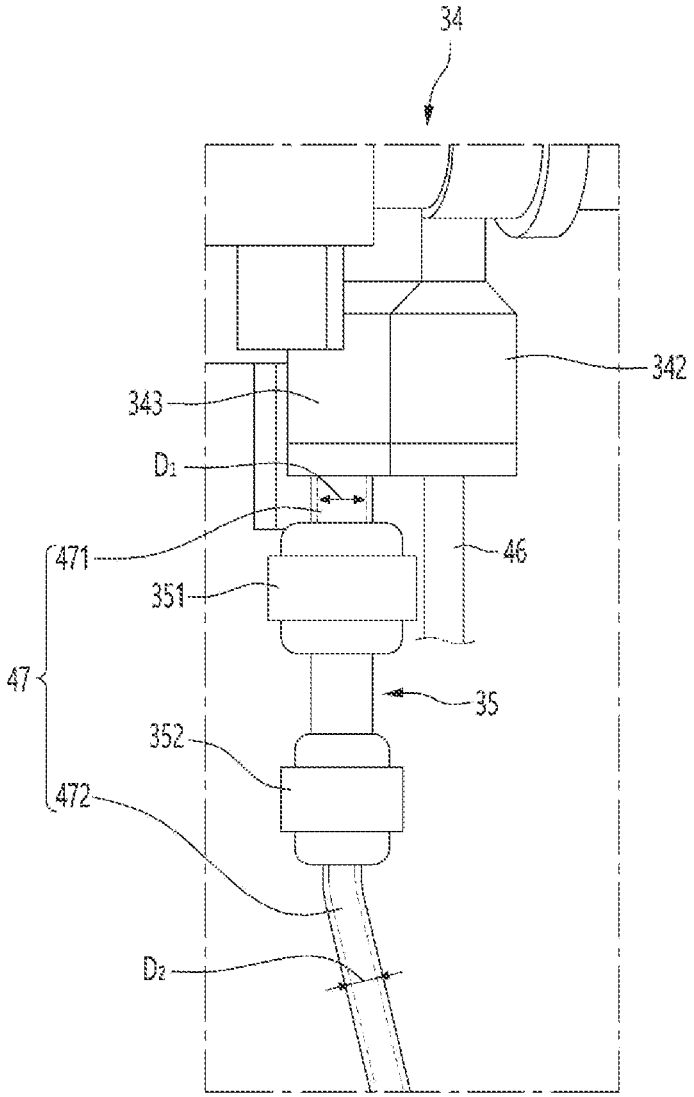
FIG. 7 is an enlarged view illustrating part A of FIG. 6.

FIG. 6 is a view illustrating the arrangement of the tank cover and the components mounted on the tank cover, and FIG. 7 is an enlarged view illustrating part A of FIG. 6.

As illustrated, the cover 31 may be formed in a rectangular shape, and the circumference of the cover 31 may extend rearward. In addition, the cover fixing part 313 may be formed at one end of the circumference of the cover 31.

The water tank 32 may be disposed on the rear surface of the cover 31. In this case, the water tank 32 may be formed in a shape in which a tube is wound several times in a circular shape. In other words, the water tank 32 may maintain the wound state and may maintain a state mounted on the rear surface of the cover 31. If necessary, a structure for fixing or mounting the water tank 32 may be provided on the cover 31.

The input side 321 of the water tank 32 may be disposed to pass through the sealing member 36 and may be exposed to the rear surface of the cabinet 10 through the opening 102*a*. The input side 321 of the water tank 32 may be connected to the filter output pipe 43, and an end part of the filter output pipe 43 may be the input side 321. In other words, the tube constituting the water tank 32 may be formed by winding the filter output pipe 43.

In addition, the output side 322 of the water tank 32 may be connected to the branch member 33. The branch member 33 may connect between the output side 322 of the water tank 32 and the valve input part 341 of the valve 33. In addition, the branch member 33 may be branched and connected to the second ice maker pipe 44. Accordingly, the water discharged from the water tank 32 may flow toward the second ice maker 161 along the second ice maker pipe 44.

The second ice maker pipe 44 may be disposed to pass through the sealing member 36 and may pass through the opening 102*a* and be exposed to the rear surface of the cabinet 10. The second ice maker pipe 44 exposed to the rear surface of the cabinet 10 may be connected to the ice maker valve 143 inside the machine room 14.

At this time, the output side 322 of the water tank 32, the branch member 33, and the valve input part 341 are located above the cover 31, and the second ice maker pipe 44 may be extended toward the lower side.

Meanwhile, the valve 33 may be disposed on the rear surface of the cover 31. The valve 33 is for supplying water supplied from the output side 322 of the water tank 32 to the dispenser 24 and the first ice maker 261 and may be composed of a three-way valve (2way). Accordingly, the water in the water tank 32 may be selectively supplied to the first ice maker 261 or the dispenser 24 according to the operation of the valve 33. For the operation of the valve 33, a cable for supplying power is connected to the valve 33, and a connector 35 is provided at the end part of the cable so that it can be easily coupled to the connector part 102*b*. In addition, the valve 34 is provided with a valve bracket 344 so that the valve is fixedly mounted to the cover 31.

The valve 33 may include a valve input part 341 through which water supplied from the output side of the water tank 32 is introduced, a dispenser-side output part 343 connected to the dispenser pipe 47, and the ice maker-side output part 342 connected to the first ice maker pipe 46.

In addition, the first ice maker pipe 46 connected to the ice maker-side output part 342 may be disposed to pass through the sealing member 36 and pass through the opening 102*a* and be exposed on the rear surface of the cabinet 10. The first ice maker pipe 46 exposed to the rear surface of the cabinet 10 may extend upward along the rear surface of the cabinet 10. In addition, the first ice maker pipe 46 is directed toward the door-side connection part 103*a* formed at the upper corner of the rear top of the cabinet 10, that is, at the upper corner of the back plate 103.

The door-side connection part 103*a* may be formed at a corner opposite to the filter-side connection part 103*c* and may be formed at the rear of the hinge device 201 on which the freezing chamber door 21 is mounted.

The first ice maker pipe 46 is inserted through the door-side connection part 103*a* and may pass through the upper surface of the cabinet 10. In other words, the first ice maker pipe 46 may be embedded in an adiabatic material forming the upper surface of the cabinet 10 and may extend to the inside of the freezing chamber door 21 through the hinge device 201.

If necessary, the first ice maker pipe 46 may divided into a pipe 461 extending from the valve 33 to the door-side connection part 103*a*, and a pipe 462 connecting from the first ice maker 261 to the door-side connection part 103*a*, so that the assembly operation can be made easier by being connected from the door-side connection part 103*a* by the separate connector 451.

A dispenser pipe 47 connected to the dispenser-side output part 343 may connect a space between the valve 33 and the dispenser 24. In addition, the dispenser pipe 47 may include a first pipe 471 and a second pipe 472.

In detail, one end of the first pipe 471 may be connected to the dispenser-side output part 343 and a connector 35 may be formed at the other end thereof. In addition, one end of the second pipe 472 may be connected to the connector 35. Accordingly, the water passing through the valve 33 passes through the first pipe 471, the connector 35, and the second pipe 472 in order.

In this case, the connector 35 may be located behind the cover 31, that is, inside the refrigerating chamber 12. Accordingly, the first pipe 471 connecting the valve 33 and the connector 35 may also be located behind the cover 31, that is, inside the refrigerating chamber 12. In addition, a part of the second pipe 472 connected to the connector 35 may be located behind the cover 31, that is, inside the refrigerating chamber 12.

In addition, the second pipe 472 may be disposed to pass through the sealing member 36 and may pass through the opening 102*a* and be exposed to the rear surface of the cabinet 10. The second pipe 472 exposed to the rear surface of the cabinet 10 may extend upward along the rear surface of the cabinet 10. In addition, the second pipe 472 is directed toward the door-side connection part 103*a*.

In other words, a substantial part of the second pipe 472 may be exposed to the rear surface of the cabinet 10. Accordingly, the water inside the second pipe 472 is inevitably affected by the outside air temperature. In particular, when the first cup of water is discharged through manipulation of the dispenser 24 in a state where the dispenser 24 has not been used for a long period of time, the temperature of the supplied water supplied to the dispenser 24 is inevitably increased by being affected by the second pipe 472 which is externally exposed.

The inner diameter D2 of the second pipe 472 may be smaller than inner diameter D1 of the first pipe 471 in order to prevent an increase in the temperature of the water discharged due to the water inside the second pipe 472.

For example, the first pipe 471 connected to the valve 33 may be formed to have an inner diameter D1 of 5.5 mm. In addition, the second pipe 472 may be formed to have an inner diameter D2 of 4.2 mm.

Accordingly, compared to the structure in which the pipe connected to the valve 33 is connected to the dispenser 24 in the form of a single pipe, the amount of water accommodated in the part exposed to the outside can be reduced, thereby preventing the temperature of the discharged water from rising. In addition, the inner diameter D2 of the second pipe 472 is set to have an appropriate size so that a sufficient flow rate of water can be supplied to the dispenser 24 while satisfying the temperature condition of the water discharged, and it can be done so that the water supply can be completed within the set time.

In addition, the connector 35 may include a first connection part 351 connected to the first pipe 471, a second connection part 352 connected to the second pipe 472, and the intermediate part 353 between the first connection part 351 and the second connection part 352.

The first connection part 351 is formed to have an inner diameter corresponding to an outer diameter of the first pipe 471 so that an end part of the first pipe 471 may be inserted thereinto. In addition, the second connection part 352 is formed to have an inner diameter corresponding to the outer diameter of the second pipe 472, so that an end part of the second pipe 472 may be inserted thereinto. Accordingly, the inner diameter of the first connection part 351 may be larger than the inner diameter of the second connection part 352.

Meanwhile, the inner diameter D1 of the first pipe 471 may be formed to be larger than the inner diameter of the first ice maker pipe 46, so that the it is possible to prevent the pipes from being erroneously assembled at the ice maker-side output part 342 and the dispenser-side output part 343. In addition, the inner diameters D2 of the first ice maker pipe 46 and the second pipe 472 may be the same.

The dispenser pipe 47 and the first ice maker pipe 46 connected to the valve 33 may extend downward. In addition, a guide part 315 for guiding the disposition of the dispenser pipe 47 and the first ice maker pipe 46 may protrude from the rear surface of the cover 31. The guide part 315 may be formed to protrude below the valve 33.

In addition, a pipe support part 314 may be formed to protrude from the cover 31. The pipe support part 314 may be formed at a position corresponding to the opening 102*a*, guide the water supply path 40 toward the opening 102*a*, and be fixed to maintain an accurate position.

In other words, the filter input pipe 42, the first ice maker pipe 46, the second ice maker pipe 44, and the second pipe 472 may be disposed on the pipe support part 314. In addition, the sealing member 36 may be positioned at an end part of the pipe support part 314. Accordingly, when the cover 31 is mounted, the water supply path 40 passing through the opening 102*a* is disposed, and the sealing member 36 may shield the opening 102*a*.

In addition, in a case where maintenance of the water tank 32 or the valve 33 or service work of the water supply path 40 is required, when the cover 31 is separated, it is easily accessible. In addition, by mounting the cover 31 after the service operation, it is possible to simultaneously mount the components on the rear surface of the cover 31.

Hereinafter, the flow state of water in the refrigerator according to an embodiment of the present disclosure having the above configuration will be described in more detail with reference to the drawings.

Figure 8:
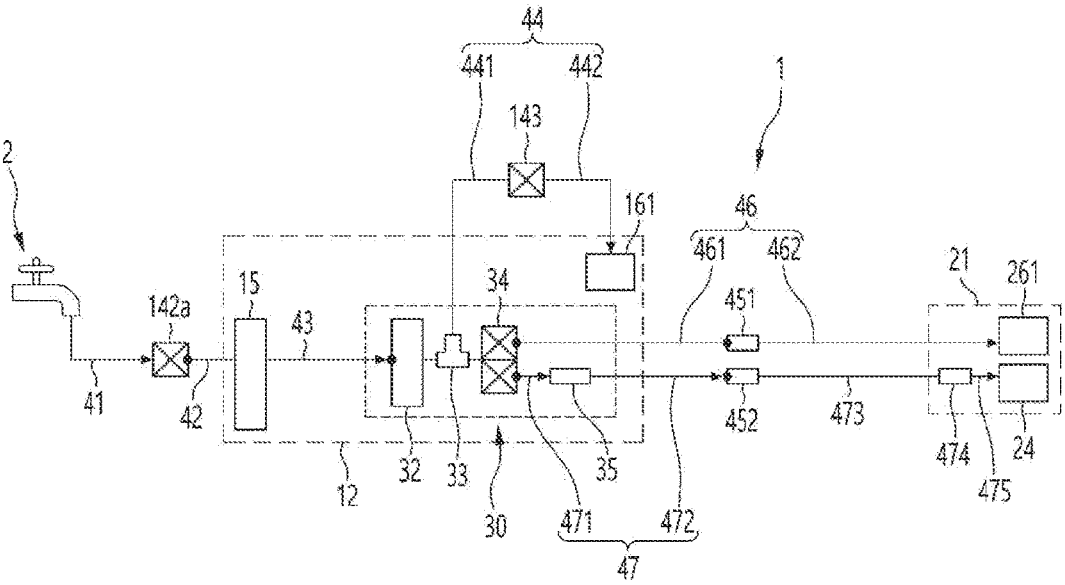
FIG. 8 is a diagram schematically illustrating an entire water flow path of a refrigerator according to an embodiment of the present disclosure.

FIG. 8 is a diagram schematically illustrating an entire water flow path of a refrigerator according to an embodiment of the present disclosure.

Referring to FIGS. 2, 3 and 8, water supplied from the water supply source 2 flows to the water supply valve 142*a* through the water supply pipe 41. Water being supplied may be supplied to the filter 15 through the filter input pipe 42 when the water supply valve 142*a* is opened.

Water purified by the filter 15 may be supplied to the water tank 32 through the filter output pipe 43. The water stored in the water tank 32 may be cooled to a set temperature by cold air inside the refrigerating chamber 12.

Water from the water tank 32 may be supplied to the second ice maker 161 through a second ice maker pipe 44 connected to the branch member 33. When the ice making signal of the second ice maker 161 is input, the ice maker valve 143 is opened to supply water to the second ice maker 161 along the second ice maker pipe 44.

In addition, the water in the water tank 32 may be supplied to the first ice maker 261 or the dispenser 24 according to the operation of the valve 33.

When the ice maker-side output part 342 is opened, water from the water tank 32 may be supplied to the first ice maker 261 along the first ice maker pipe 46. In other words, when an ice-making signal from the first ice maker 261 is input, the valve 33 is operated and water from the water tank 32 is supplied to the first ice maker 261 through the first ice maker pipe 46.

In addition, in a case where the dispenser-side output part 343 is opened, water from the water tank 32 may be supplied to the dispenser 24 along the dispenser pipe 47. At this time, a part of the first pipe 471 connected to the valve 33, the connector 35, and the second pipe 472 connected to the connector 35 is located inside the refrigerating chamber, and therefore, the water within the pipe will remain in a cooling state.

In addition, the water inside the second pipe 472 positioned between the rear opening 103*b* and the door-side connection part 103*a* of the rear surface of the cabinet 10 is affected by the outside air. In this case, the inner diameter D2 of the second pipe 472 has a smaller inner diameter than the first pipe D1, so that the amount of water affected by the outside air can be minimized.

In this state, when the user operates the dispenser 24, the valve 33 is operated, and the water passing through the first pipe 471, the connector 35, and the second pipe 472 is directed to the dispenser 24.

In addition, as the amount of water whose temperature is increased by outside air inside the second pipe 472 is minimized, the temperature rise of the water discharged from the dispenser 24 is also minimized, and the temperature of the water discharged can be satisfied within the set range.

Meanwhile, the dispenser pipe 47 may include a third pipe 473. The third pipe 473 may extend from the door-side connection part through the upper surface of the cabinet 10 and the hinge device 201 to the inside of the freezing chamber door 21.

In addition, the third pipe 473 may be connected to the second pipe 472 by a cabinet connector 452 at the door-side connection part 103*a*. The third pipe 473 may have an inner diameter smaller than the inner diameter D2 of the second pipe 472. For example, the third pipe 473 may have an inner diameter of 3.1 mm. Therefore, it is possible to ensure the adiabatic performance by minimizing the loss of space between the upper surface of the cabinet 10 through which the third pipe 473 passes and the adiabatic material inside the freezing chamber door 21, and the inner diameter of the hinge device 201 through which the third pipe 473 passes can be minimized.

In addition, a dispenser connector 474 may be connected to an end part of the third pipe 473, and a fourth pipe 475 may be connected to the other end of the dispenser connector 474 which is connected to the ejection nozzle of the dispenser 24.

In other words, the dispenser pipe 47 may include a fourth pipe 475 connected to the ejection nozzle. The fourth pipe 475 may have a larger diameter than the third pipe 473. Therefore, the flow rate of the water discharged from the dispenser 24 is not excessively fast and can be properly maintained, thereby preventing water from splashing. For example, the inner diameter of the fourth pipe 475 may be the same as the inner diameter of the second pipe 472.

In addition to the above-described embodiments, the present disclosure may be capable of various other embodiments. Another embodiment of the present disclosure is characterized in that it is applied to a refrigerator that is not equipped with the second ice maker. Among the components of other embodiments of the present disclosure, the same components as those of the above-described embodiment are denoted by the same reference numerals, and detailed descriptions thereof will be omitted.

Figure 9:
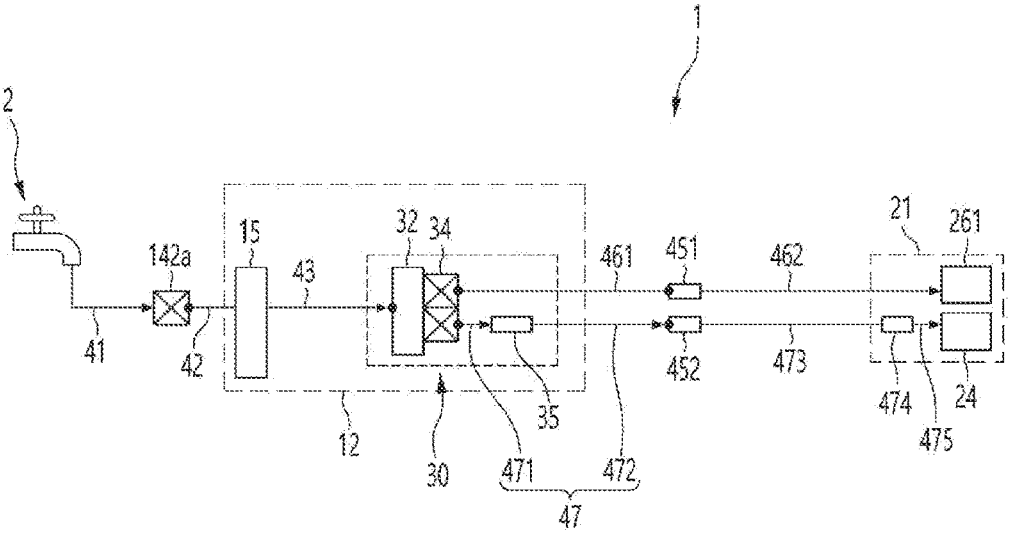
FIG. 9 is a diagram schematically illustrating an entire water flow path of a refrigerator according to another embodiment of the present disclosure.

FIG. 9 is a diagram schematically illustrating an entire water flow path of a refrigerator according to another embodiment of the present disclosure.

As illustrated, the refrigerator 1 according to another embodiment of the present disclosure may have the same configuration as the above-described embodiment except for the second ice maker 161 and the pipes connected to the second ice maker 161.

In detail, the water supplied from the water supply source 2 flows to the water supply valve 142*a* through the water supply pipe 41. Water being supplied may be supplied to the filter 15 through the filter input pipe 42 when the water supply valve 142*a* is opened.

Water purified by the filter 15 may be supplied to the water tank 32 through the filter output pipe 43. The water stored in the water tank 32 may be cooled to a set temperature by cold air inside the refrigerating chamber 12.

Water from the water tank 32 may be supplied to the dispenser 24 and the first ice maker 261 by a valve 33.

In detail, in a case where the ice maker-side output part 342 is opened, water from the water tank 32 may be supplied to the first ice maker 261 along the first ice maker pipe 46. In other words, when an ice-making signal from the first ice maker 261 is input, the valve 33 is operated and water from the water tank 32 can be supplied through the first ice maker pipe 46 to the first ice maker 261.

In addition, when the dispenser-side output part 343 is opened, water from the water tank 32 may be supplied to the dispenser 24 along the dispenser pipe 47. At this time, a part of the first pipe 471 connected to the valve 33, the connector 35, and the second pipe 472 connected to the connector 35 is located inside the refrigerating chamber 12, Therefore, the water in the pipe maintains a cooling state.

In addition, the water inside the second pipe 472 positioned between the rear opening 103*b* and the door-side connection part 103*a* of the rear surface of the cabinet 10 is affected by the outside air. In this case, the inner diameter D2 of the second pipe 472 may be smaller than the inner diameter D1 of the first pipe 471 to minimize the amount of water affected by the outside air.

In this state, when the user operates the dispenser 24, the valve 33 is operated, and the water passing through the first pipe 471, the connector 35, and the second pipe 472 is directed to the dispenser 24.

In addition, as the amount of water whose temperature is increased by outside air inside the second pipe 472 is minimized, the temperature rise of the water discharged from the dispenser 24 is also minimized, and the temperature of the water discharged is to be satisfied within the set range.

In addition, if necessary, the dispenser pipe 47 may further include the third pipe 473 and the fourth pipe 475, and the water in the water tank 32 passes through these pipes in turn and thus may be guided to the dispenser 24.

In the above description, numerous specific details are set forth in order to provide a thorough understanding of the present disclosure. The present disclosure may be practiced without some or all of these specific details. Examples of various embodiments have been illustrated and described above. It will be understood that the description herein is not intended to limit the claims to the specific embodiments described. On the contrary, it is intended to cover alternatives, modifications, and equivalents as may be included within the spirit and scope of the present disclosure as defined by the appended claims.

In the refrigerator according to the proposed embodiment, the following effects can be expected.

According to an embodiment of the present disclosure, among the pipes connecting the water tank and the dispenser, the inner diameter of the second pipe exposed to the outside of the cabinet is smaller than the inner diameter of the first pipe disposed inside the refrigerating chamber, and the first pipe and the second pipe are connected by a connector.

Accordingly, the volume of water in the second pipe that affects the temperature of the first cup when water is discharged through the dispenser can be minimized so that the temperature of the first cup of water discharged through the dispenser may satisfies a set temperature range.

In other words, even if the indoor temperature is high like in summer or the dispenser is operated after not using the dispenser for a long time, the temperature of the first cup is not excessively high and the water can be dispensed in a state of satisfying the set temperature, thereby relieving the user's inconvenience.

In addition, the second pipe has a structure connected to the first pipe inside the refrigerating chamber by the connector so that the second pipe with a small diameter can pass through the cabinet and be exposed rearwardly. Accordingly, the size of the opening passing through the cabinet can be minimized, and there is an advantage in that thermal insulation performance can be secured through this.

In addition, by making the diameters of the ice maker pipe connected to the valve and the dispenser pipe different, erroneous assembly can be prevented when the valve and the pipe are connected, and assembly work convenience and productivity can be improved.

In addition, by setting the inner diameter of the dispenser pipe to an appropriate inner diameter, there is an advantage in that the amount of water exposed to the outside of the refrigerator can be minimized and the flow rate and flow velocity of water discharged from the dispenser can be properly secured.

In addition, since the water tank, the valve, and a part of the water supply path can be disposed on the cover provided inside the refrigerating chamber, these components can be arranged or separated only by detaching the cover when assembling or when maintenance is required, and thus there is an advantage in that assembly and maintenance convenience are improved.

In addition, even when two ice makers and a dispenser are disposed in a double-door refrigerator, the piping and valves can be efficiently disposed, and assembling workability can be secured.

What is claimed is:

1. A refrigerator comprising:

a cabinet that defines a refrigerating chamber and a freezing chamber, the cabinet comprising a back plate that defines a rear surface of the cabinet and is exposed outside of the cabinet;

a water storage disposed inside the refrigerating chamber and configured to store water;

a door rotatably connected to the cabinet by a hinge, the door being configured to rotatably open and close at least a portion of the refrigerating chamber or the freezing chamber;

a dispenser disposed at the door and configured dispense the water; and a water supply path that connects the water storage to the dispenser through the hinge and is configured to supply the water from the water storage to the dispenser, wherein the water supply path comprises:

a first pipe disposed in the refrigerating chamber and connected to an output side of the water storage, a second pipe that is connected to the first pipe and extends toward the dispenser, the second pipe passing through the back plate and extending along the back plate to a top of the cabinet, a third pipe that passes through the back plate and an upper surface of the cabinet and extends to an inner part of the door through the hinge, a fourth pipe connected to the dispenser, a connector that is disposed in the refrigerating chamber and connects the first pipe to the second pipe, a cabinet connector that is disposed at the third pipe and connects the second pipe to the third pipe, and a dispenser connector that is disposed inside the door and connects the third pipe to the fourth pipe, wherein a portion of the third pipe and the cabinet connector are exposed outside of the cabinet, and wherein an inner diameter of the second pipe is less than an inner diameter of the first pipe, an inner diameter of the third pipe is less than the inner diameter of the second pipe, and an inner diameter of the fourth pipe is equal to the inner diameter of the second pipe.

2. The refrigerator of claim 1, further comprising:

a filter disposed inside the refrigerating chamber and configured to purify the water supplied to the water storage.

3. The refrigerator of claim 1, wherein the refrigerating chamber is arranged at one of a left right or a right side of the refrigerator, and the freezing chamber is arranged at the other of the left right or the right side of the refrigerator, and wherein the door comprises a freezing chamber door configured to open and close the freezing chamber, the dispenser being disposed at the freezing chamber door.

4. The refrigerator of claim 1, wherein an inner diameter at an end of the connector connected to the first pipe is greater than an inner diameter at another end of the connector connected to the second pipe.

5. The refrigerator of claim 1, wherein the back plate defines an opening, wherein the second pipe passes through the opening of the back plate, and wherein the refrigerator further comprises a cover that is disposed in the refrigerating chamber and covers the opening and the water storage, the cover defining a portion of a rear side of the refrigerating chamber.

6. The refrigerator of claim 5, wherein the water storage has a tube shape in a wound state in which the water storage is wound one or more times in a circular shape, and wherein the water storage is mounted on a rear surface of the cover and maintains the wound state.

7. The refrigerator of claim 5, wherein the cover covers a part of each of the first pipe, the connector, and the second pipe.

8. The refrigerator of claim 5, further comprising a valve that connects the output side of the water storage to the first pipe, wherein the valve, the water storage, and the second pipe are mounted on a rear surface of the cover.

9. The refrigerator of claim 5, wherein the water supply path further comprises a plurality of pipes that pass through the opening of the back plate, the plurality of pipes including the second pipe and a pipe that defines an input side of the water storage, and wherein the cover comprises a pipe support that protrudes from a rear surface of the cover and supports the plurality of pipes.

10. The refrigerator of claim 9, further comprising a sealing made of an insulation material and provided in the opening, the sealing being covered by the cover, wherein the plurality of pipes pass through the sealing.

11. The refrigerator of claim 5, wherein the cover comprises a cover fixing protrusion that extends from a side of the cover and is coupled to the back plate of the refrigerating chamber, and wherein the cover fixing protrusion protrudes rearward from the cover to the back plate of the refrigerating chamber to thereby maintain a predetermined distance between the cover and the back plate of the refrigerating chamber.

12. The refrigerator of claim 5, further comprising a drawer that is disposed in the refrigerating chamber and covers a front surface of the cover.

13. The refrigerator of claim 12, wherein the cover defines a cold air hole configured to receive air for cooling the water storage, the cold air hole being defined at the front surface of the cover and facing at least a portion of the water storage.

14. A refrigerator comprising:

a cabinet comprising a back plate that defines a rear surface of the cabinet and is exposed outside of the cabinet, the cabinet defining:

a refrigerating chamber arranged at one of a left right or a right side of the refrigerator, a freezing chamber arranged at the other of the left right or the right side of the refrigerator, and a machine room arranged at a lower portion of the refrigerator;

a refrigerating chamber door configured to open and close the refrigerating chamber;

a freezing chamber door configured to open and close the freezing chamber;

a first ice maker disposed in the freezing chamber door;

a second ice maker disposed in the freezing chamber;

a water supply valve disposed in the machine room and configured to adjust a flow of water supplied from a water supply source;

a filter configured to be disposed in the refrigerating chamber and configured to purify the water supplied from the water supply source;

a water storage disposed in the refrigerating chamber and configured to store the water purified by the filter;

a dispenser disposed in the freezing chamber door and configured to dispense ice made by the first ice maker and the water in the water storage to an outside of the refrigerator; and a water supply path that connects the water supply source, the water supply valve, the filter, the water storage, the first ice maker, the second ice maker, and the dispenser, wherein the water supply path comprises:

a first pipe disposed in the refrigerating chamber and connected to an output side of the water storage, a second pipe that is connected to the first pipe and extends toward the dispenser, the second pipe passing through the back plate and extending along the back plate to a top of the cabinet, a third pipe that passes through the back plate and an upper surface of the cabinet and extends to an inner part of the freezing chamber door through a hinge, a fourth pipe connected to the dispenser, a connector that is disposed in the refrigerating chamber and connects the first pipe to the second pipe, a cabinet connector that is disposed at the third pipe and connects the second pipe to the third pipe, and a dispenser connector that is disposed inside the freezing chamber door and connects the third pipe to the fourth pipe, and wherein an inner diameter of the second pipe is less than an inner diameter of the first pipe, an inner diameter of the third pipe is less than the inner diameter of the second pipe, and an inner diameter of the fourth pipe is equal to the inner diameter of the second pipe.

15. The refrigerator of claim 14, wherein the water supply path further comprises:

a water supply pipe that connects the water supply source to the water supply valve;

a filter input pipe that connects the water supply valve to the filter;

a filter output pipe that connects the filter to the water storage;

a first ice maker pipe that connects the water storage to the first ice maker; and a second ice maker pipe that connects the water storage to the second ice maker.

16. The refrigerator of claim 15, wherein the back plate defines an opening, wherein the filter output pipe, the first ice maker pipe, the second ice maker pipe, and the second pipe pass through the opening of the back plate, and wherein the refrigerator further comprises a cover that is disposed in the refrigerating chamber and covers the water storage and the opening, the water storage being mounted to the cover.

* * * * *